United States Patent [19]

South

[11] 3,933,006

[45] Jan. 20, 1976

[54] SUPERMARKET PRODUCE DISPLAY FIXTURE

[75] Inventor: Lewis E. South, Kansas City, Mo.

[73] Assignee: The Weather Box Company, Kansas City, Mo.

[22] Filed: May 9, 1974

[21] Appl. No.: 468,232

[52] U.S. Cl. ..... 62/231; 62/247; 62/256; 62/78; 62/176; 426/321; 426/327

[51] Int. Cl.[2] ..... F25B 19/00

[58] Field of Search ..... 62/247, 256, 176, 78, 231; 426/34, 327

[56] References Cited

UNITED STATES PATENTS

| | | | |
|---|---|---|---|
| 2,130,430 | 9/1938 | Maginnis | 62/176 |
| 2,531,506 | 11/1950 | Geneck | 62/247 |
| 2,754,660 | 7/1956 | Morrison | 62/176 |
| 2,822,672 | 2/1958 | Dickson | 62/256 |
| 2,890,573 | 6/1959 | Lamb | 62/256 |
| 2,904,254 | 9/1959 | Bahnson | 62/176 |
| 2,981,081 | 4/1961 | Larsen | 62/176 |
| 3,102,777 | 9/1963 | Bedrosean | 21/58 |
| 3,186,185 | 6/1965 | Bently | 62/256 |
| 3,256,709 | 6/1966 | Stepleton | 62/256 |
| 3,347,145 | 10/1967 | Steelman | 62/256 |
| 3,365,307 | 1/1968 | Dixon | 426/231 |
| 3,403,525 | 10/1968 | Beckwith | 62/256 |

*Primary Examiner*—William J. Wye

*Attorney, Agent, or Firm*—Schmidt, Johnson, Hovey & Williams

[57] ABSTRACT

An in-store fixture for the displaying of bananas or the like in an atmosphere of controlled temperature and humidity has a plurality of support members that accommodate a number of banana hands in a substantially vertically oriented display. The support members are arranged to accommodate the banana hands in a substantially spaced, noncontacting relationship relative to one another such that a zone or curtain of circulating, temperature and humidity controlled air essentially surrounds each respective banana hand. Individual banana hands are held by respective hook elements depending from their associated support members to permit removal of any selected one banana hand without the need for handling adjacent hands, thereby significantly reducing wastage caused by excessive handling of the product and undesirable contact of the same with one another. Controlled curing of the bananas in the fixture is possible through the use of a selectively controlled dispenser adapted to release a curing agent into the controlled air circulating about the bananas.

1 Claim, 4 Drawing Figures

SUPERMARKET PRODUCE DISPLAY FIXTURE

This invention relates to a display fixture for the merchandising of bananas or the like and is especially adapted for use in retail outlets such as supermarkets.

Normally, produce buyers purchase bananas for delivery to retail outlets in a semi-ripe condition in an effort to minimize waste and associated losses due to spoilage before the bananas can be merchandised. It has been common practice to pile the bananas, which are usually sold in hands of four to seven bananas per hand, on a table or counter at ambient room temperature and permit them to ripen at an uncontrolled rate while on display. In this connection, it is characteristic of bananas to develop dark spots on their skins where they come into contact with one another which hastens the spoilage rate and contributes to uneven ripening. Also, it is the usual practice for the customer to search through the pile for a hand of bananas that appears to be in a desired state of ripeness and, in so searching through the pile, the customer tends to damage the bananas because of the handling thereof thus further compounding the losses due to spoilage.

It is, therefore, a very important object of my invention to provide a supermarket produce display fixture particularly designed to display and hold bananas at the industry standard level of controlled temperature and humidity.

Yet another important object of the invention is to provide a display fixture for bananas or the like in which temperature and humidity controlled air is discharged into a banana display compartment in a manner to present a controlled atmosphere therein defined by a circulating curtain of air.

Still another very important object of the instant invention is to provide a produce display fixture for bananas or the like in which support members are disposed within a display compartment and are adapted to accommodate banana hands in an essentially vertically oriented display, and in such a manner that the banana hands are in a substantially spaced relationship relative to one another such that a zone of the controlled atmosphere substantially surrounds each respective banana hand or the like.

Another important object closely related to the foregoing is that of providing support members for displaying the banana hands that permit the removal of a selected one of the banana hands without requiring the handling or removal of any adjacent banana hands.

A still further object is to provide a produce display fixture having provision for dispensing a banana curing or ripening agent into the air being circulated through the fixture to control the rate of ripening of the bananas therein.

Figures 1, 2, 3, 4, 5:
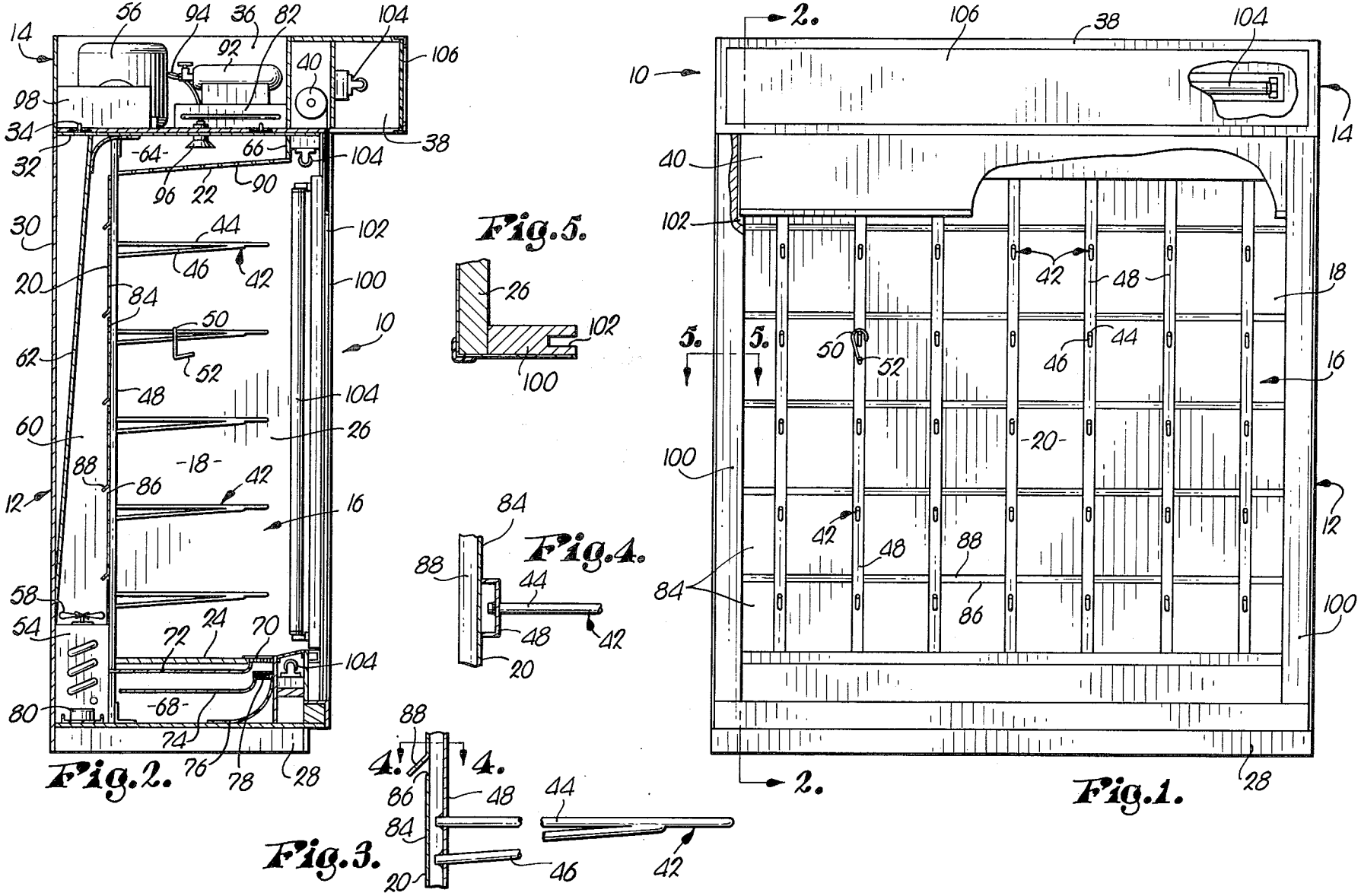
FIG. 1 is a front elevational view of a supermarket produce display fixture made pursuant to the present invention and particularly adapted for bananas, portions of the fixture being broken away and shown in section to disclose details of construction.
FIG. 2 is a vertical cross-sectional view of the fixture taken along line 2—2 of FIG. 1.
FIG. 3 is a fragmentary, enlarged, vertical cross-sectional view showing a support member for the produce and further illustrating details of construction of a controlled air opening associated with the support members.
FIG. 4 is a fragmentary cross-sectional view taken along line 4—4 of FIG. 3 showing additional details of construction of the support member and its associated louvered air control opening.
FIG. 5 is a fragmentary cross-sectional view taken along line 5—5 of FIG. 1 revealing details of construction of a front, upright corner of the fixture.

An in-store produce display fixture, broadly designated by the numeral 10, is particularly adapted to present a temperature and humidity controlled atmosphere for bananas or the like. The fixture 10 is comprised of two basic units, a base unit 12 and an upper unit 14, supported by the base unit 12, which define a self-contained fixture suitable for installation in the produce section of a supermarket or the like.

The base unit 12 includes a display case 16 provided with a normally open-front produce compartment 18 defined by a back wall 20, a top wall 22, a bottom wall 24, and opposed sidewalls 26. Construction of the fixture 10 is of the kind conventionally found in connection with other types of refrigeration cases usually placed in supermarket produce departments. Generally, the lower unit 12 has a base 28, an upright, rear panel 30, and a top panel 32 having pin locators 34 which receive and position the upper unit 14 on the case 16. The top unit 14 generally includes a space 36 for certain of the operating components which will be hereinafter more fully described, a display canopy 38 overhanging the lower unit 12 and extending across the front of the fixture, and a pulldown night cover 40 disposed to close off the open front of the compartment 18 when the cover 40 is in an extended or lowered condition.

The banana hands (not shown) are accommodated within the compartment 18 by a plurality of support members 42 arranged along the back wall 20 in a plurality of vertically spaced, horizontally disposed rows. Each support member 42 is designed to accommodate a plurality of banana hands and is of a trussed cantilevered design in the form of an arm 44 and an underlying brace 46, both of which are permanently affixed to an upright arm support 48 extending substantially the full length of the back wall 20 and receiving a number of members 42. A plurality of such arm supports 48 with their members 42 are spaced transversely across the wall 20 as best shown in FIG. 1. Thus, it will be seen that the horizontally disposed members 42 extending from the back wall 20 with their cantilever arms 44 projecting forwardly into the compartment 18, cooperate to present a vertically arranged display of bananas which are in a substantially spaced, vertically oriented relationship relative to one another.

Each support member 42 is further provided with a number of individual, selectively shiftable hook elements 50 adapted to depend from its member 42 and which terminates in a forwardly and slightly upwardly inclined length 52 adapted to receive a single banana hand. The arms 44 are of a sufficient length to hold several hooks 50 longitudinally therealong without adjacent banana hands being in physical contact with one another.

Cooled, temperature-controlled air is provided for circulation through the compartment 18 by a cooling coil 54 disposed on the base 28 between the back wall 20 and the rear panel 30 and operably coupled with a cooling compressor 56 located in the space 26 of the upper unit 14. The cooling coil 54 extends the full horizontal length of the case 16, and an arrangement of electrically driven air circulating fans 58 (only one shown) are suitably located along the coil 54 to move the air in an upward direction, as it leaves the coil 54, along a passageway 60 defined by the back wall 20, the upright sidewalls 26, an upwardly and forwardly inclined partition 62 extending the full distance between the sidewalls 26 and upwardly to the top panel 32. The air is cooled and maintained in a range of 55° to 58° F. (optimum 55°) inasmuch as the bananas get gray below 52° and speck too soon at temperatures above 75°.

The passageway 60 communicates at its upper end with a cold air plenum 64 being defined by that space between the top wall 22 of the compartment 18 and the top panel 32 of the base unit 12, there being an upright front wall 66 extending between the upright sidewalls 26 and between the horizontal top wall and panel 22 and 32 respectively, proximal the front of the case 16. There is a return air plenum 68 between the bottom wall 24 of the compartment 18 and the base 28 with a return air grill 70 being located in the bottom wall 24. A series of air distribution vanes 72, 74 and 76 are generally horizontally disposed in the return air plenum 68 for properly distributing the air across the coil 54 as it is drawn from the compartment 18 to the plenum 68 and across the coil 54. It is to be understood that these vanes 72–76 extend the full distance between the opposed sidewalls 26.

A humidistat 78 is located in the return air plenum 68 immediately below the grill 70 for sensing the humidity in the air, and it is operably coupled with conventional means (not shown) for controlling the amount of moisture in the air circulated through the compartment 18. A condensate pump 80 is located beneath the coil 54 for transferring the water condensed from the air as it passes the coils 54 to an element-equipped evaporating pan 82 located in the upper unit 14 adjacent the compressor 56.

In addition to the airflow directing structure presented by the passageway 60, cold air plenum 64, and return air plenum 68; the back wall 20, which is made up of a number of snap-in inserts 84 disposed and suitably held between the arm supports 48, includes a number of elongated slots 86 between the successively, vertically spaced inserts 84. It will be seen by referring to FIG. 1 that the slots 86 thus extend in horizontal rows across the back wall 20 in a number of vertically spaced rows corresponding to the rows of support members 42 and are located just above the latter. The horizontal, lower edges of each of the inserts 84 are flanged rearwardly and downwardly at an angle to present an air-directing louver 88 projecting into the passageway 60. Accordingly, it will be noted that a portion of the air moving upwardly in the passageway 60 will be diverted at each of the rows of slots 86 across the back of the compartment 18 and directed over the banana hands suspended from the support members 42 by way of the hook elements 50. Further, reference to FIG. 2 will reveal that the top wall 22 has a number of perforations 90 therein so that the air not diverted at the slots 86 but conveyed to the plenum 64 may pass therefrom downwardly into the compartment 18, thus providing a curtain of temperature and humidity controlled air therethrough.

If desired, an aerosol cylinder 92 containing a banana curing agent, such as ethylene, may be mounted in the space 36 and connected by a tube 94 to a dispensing nozzle 96 located in the cold air plenum 64 to release the ethylene into the air for purposes of controlling the ripening process of the bananas. Suitable controls for the air-cooling components, the humidifying components, and the time-controlled ethylene dispensing components are contained in a control box 98 mounted in the upper unit 14.

The night cover 40 also serves to contain the ethylene curing gas when in an extended position, and to this end, the case 16 includes an upright, relatively narrow curtain wall 100 extending the full vertical length of the lower unit 12 at each lateral side. A longitudinal slot 102 runs the full length of the exposed edge of each wall 100 such that the opposed, vertical edges of the cover 40 are disposed therewithin to effectively minimize the loss of cold air and ethylene gas during the time that the cover is extended, this normally being during the nighttime or during nonbusiness hours.

The usual lighting fixtures 104 extend across the upper and lower horizontal, forward peripheral edges of the compartment 18 and along the upright forward edges to illuminate the product, and the canopy 38 also is provided with a fixture 104 for illuminating a plastic advertising insert 106.

Based on the foregoing description, it will become apparent that the fixture 10 is suitably designed to display produce, such as banana hands or the like, in a manner that is not only convenient and attractive, but more importantly, in a manner to effectively minimize the major problems of excessive losses incurred due to spoilage. More specifically, it is seen that the airflow directing structure made up of the passageway 60, the plenums 64 and 68, along with the louvered slots 86 and the perforations 90 in the top wall 22, efficiently direct the humidity and temperature-controlled air over the banana hands or the like to maintain them in an optimum atmosphere that is conducive to preservation of the bananas until the time they are merchandised. The air moving from front-to-back and from top-to-bottom in the compartment 18 sets up a circulating air pattern that forms a curtain of air therein, and the spacing between the banana hands affords a zone substantially surrounding each hand.

In addition to providing a zone of controlled atmosphere for the bananas, the manner in which they are held or accommodated by the support members 42 in a spaced, relative disposition to one another insures that they are generally maintained in an out of contact disposition with one another. The fact that the individual banana hands are individually suspended or hung from the support arms by respective hook elements 50, precludes their being unnecessarily bruised because of contact with one another, this feature further serving to reduce the losses due to spoilage. It is but a simple matter for the customer to reach into the compartment 18 and remove from its respective hook 50 that particular banana hand that has been selected, and such removal may be accomplished without the need for unnecessarily disturbing or mishandling adjacent hands. That is to say, if a customer has selected a particular hand that is adjacent the back wall 20, he need not remove those hands disposed forwardly thereof on the same member 42 because there is sufficient spacing, both vertically and horizontally, between the members 42 that a particular banana hand may normally be removed without displacing the adjacent hands.

Even though not shown, it is contemplated that in the event other types of produce are to be merchandised from the fixture 10, a shelf could be provided to rest on each horizontal row of support members 42 and still obtain virtually the same benefits of a curtain of temperature and humidity-controlled air circulating through the compartment 18 via the slots 86 and perforations 90.

Having thus described the invention, what is claimed as new and desired to be secured by Letters Patent is:

1. An in-store article display fixture for bananas comprising:

an upright display case, said case having a normally open-front display compartment defined by a back wall, a top wall, a bottom wall, opposed side walls and a curtain wall on each side of said open front;

a plurality of support members within said compartment for receiving the bananas to be displayed, said support members being in the form of arms extending from said back wall into said display compartment, said arms being adapted to receive and support hands of bananas in spaced, noncontacting relationship;

air circulating means operably associated with the case and disposed to selectively circulate air within said compartment and around the hands of bananas;

air cooling means operably associated with said case in a manner to selectively control the temperature of the air circulated within the compartment;

a pressure container containing a banana curing agent, said container being in communication with said display compartment; and control means for providing time-controlled dispensing of said curing agent into said display compartment for circulation therewithin by said air circulating means.

* * * * *